United States Patent [19]

Schulz, Jr.

[11] 4,074,372

[45] Feb. 21, 1978

[54] FOUNDATION UNIT FRAME

[75] Inventor: Martin Schulz, Jr., Brenham, Tex.

[73] Assignee: Steadley Company, Inc., Carthage, Mo.

[21] Appl. No.: 675,472

[22] Filed: Apr. 9, 1976

[51] Int. Cl.[2] ..... A47C 23/04

[52] U.S. Cl. ..... 5/263; 5/264 B; 5/239; 5/200 R

[58] Field of Search ..... 5/263, 264 R, 264 B, 5/265, 230, 239, 300, 351, 200 R

[56] References Cited

U.S. PATENT DOCUMENTS

| | | | |
|---|---|---|---|
| 733,500 | 7/1903 | Moore | 5/300 |
| 755,987 | 3/1904 | Anderson | 5/264 R |
| 3,080,576 | 3/1963 | Cervisi | 5/264 R |
| 3,633,226 | 1/1972 | Krakauer | 5/263 |
| 3,842,451 | 10/1974 | McCormick | 5/264 B |

*Primary Examiner*—Casmir A. Nunberg
*Attorney, Agent, or Firm*—Lee & Smith

[57] ABSTRACT

The invention pertains to a wooden frame structure for a box spring. Two spaced, parallel, upright members form elongated side rails which are initially held together by a base slat extending between the side rails at either end thereof, the base slats being affixed to the bottom of the side rails in recesses therein. Above each base slat, an end slat is installed extending between the side rails, each end slat having a formation such as a tenon formed on either end thereof which engages a corresponding formation such as a mortise formed in each side rail. Normally, at least one center slat, depending on the ultimate frame dimension, lies on its side between the end slats with each end of the center slat lying on a portion of the top of one of the base slats. A plurality of upright cross slats extends between the side rails, and similar to the end slats, each cross slat has a tenon formed in either end thereof which interlockingly engages a corresponding mortise formed in each side rail.

7 Claims, 4 Drawing Figures

FOUNDATION UNIT FRAME

SUMMARY OF THE INVENTION

BACKGROUND

This invention relates to a frame structure for a foundation unit such as a box spring, and more particularly to a frame which increases the strength of the foundation unit while at the same time reduces the complexity and cost of construction of the unit.

In the conventional frame for a foundation unit, the structure consists of a pair of flat side rails connected together at either end by an end rail. Normally, at least one center rail is utilized extending parallel to the side rails from one end rail to the other. A plurality of slats are placed flat across the frame from one side rail to the other, spaced at particular intervals from one end of the frame to the other. Normally, all frame sections are either stapled or nailed together.

This type of frame has several inherent disadvantages. Due to all slats being flat, there is some tendency for the slats to break in use. Since the slats are nailed or stapled together, the points of these fasteners may protrude through the side rails, contributing to torn mattress covers. Since the thickness of the frame normally is on the order of one and one-half inches, to create the normal seven inch box spring thickness, springs on the order of six inches in height must be utilized in the box spring, and thus a substantial amount of costly spring steel has to be used. Also, because the frame is either nailed or stapled together, any stress applied to the frame tends to loosen the framework, resulting in numerous rejected frames in the factory, and a number of unnecessary structural failures during use thereof.

Attempts to alleviate the above problems have previously been made. For example, U.S. Pat. No. 97,306 discloses a box spring structure which employs a plurality of rails placed on their edges between the frame of the box spring. Similarly, U.S. Pat. No. 2,773,271 discloses a frame structure in which a plurality of transverse frame members are placed on edge between a pair of longitudinal frame members. Each of these structures, although recognizing that an oblong member is stronger when oriented with its largest cross sectional dimension extending vertically, has failed to recognize the significantly greater strength of such a structure when the components are assembled in a particular manner.

THE INVENTION

The above-delineated problems and others are solved according to the present invention by providing a framework structure for a foundation unit which includes two spaced, elongated, parallel side rails which are oriented with their greatest cross sectional dimension extending generally vertically, a pair of end members, each extending between the side rails at either end thereof, a plurality of cross slat members extending between the side rails intermediate the end members and oriented with their greatest cross sectional dimension extending substantially vertically, and means for interlocking each of the cross slat members and the side rails to prevent relative movement between the portions of the framework structure.

According to a preferred embodiment of the invention, the means interlocking the cross slat members and the side rails includes a tenon formed on each end of the cross slat members and a corresponding mortise excised from the side rails at each junction between the cross slat members and the side rails. Preferably, each tenon is formed in a wedge-shaped, dovetail fashion, and the mortise is correspondingly shaped so that the interlocking engagement is in a tongue and groove fashion.

Each end member preferably includes a base slat which extends between the side rails, each base slat being preferably oriented with its greatest cross sectional dimension extending substantially horizontally within recesses cut into the side rails. An end slat, preferably oriented with its major cross sectional dimension extending generally vertically, extends between the side rails above each base slat and, similar to the cross slat members, is formed with a tenon on either end thereof which matingly engages a corresponding mortise in the side rails. The frame structure also preferably includes at least one elongated, generally flat, center slat which extends between the end slats and which is mounted with each end thereof overlying a portion of one of the base slats.

By reason of the various features and advantages of the invention as described in detail hereafter, a foundation unit frame is provided which is substantially stronger than the normal framework structure, and which, due to its increased thickness, decreases the depth of spring material which must be utilized, decreasing the overall cost. Furthermore, due to the simple, interlocking nature of the invention, it is readily shipped in an unassembled state, and assembled rapidly and accurately when the unit is constructed.

BRIEF DESCRIPTION OF THE DRAWINGS

One embodiment of the invention is illustrated in the following drawings, in which.

DETAILED DESCRIPTION OF THE PREFERRED EMBODIMENT

Figure 1:
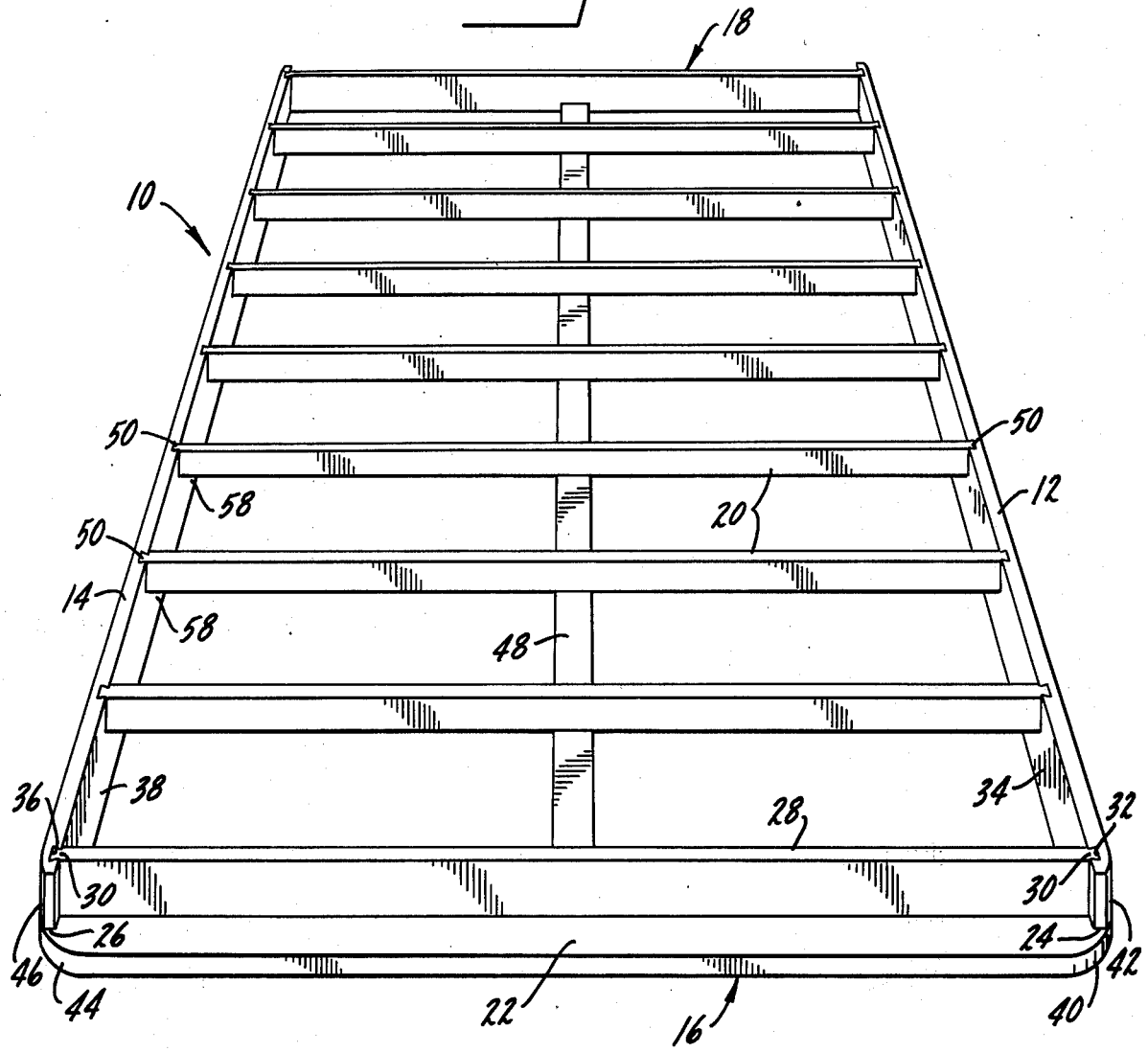
FIG. 1 is a perspective view of a foundation unit frame according to the present invention
Figure 4:
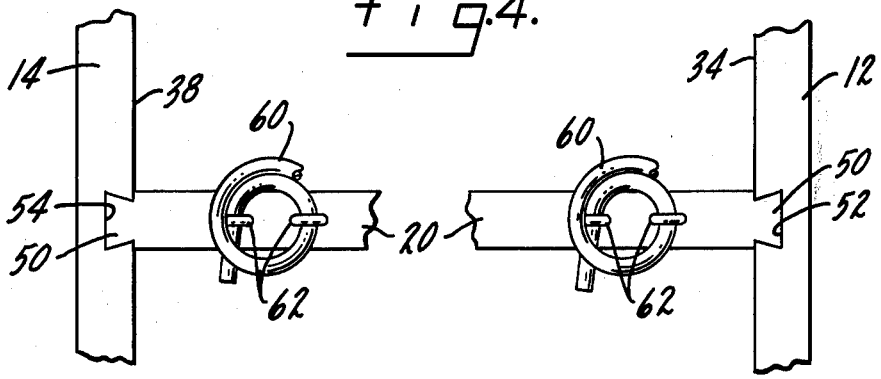
FIG. 4 is an enlarged partial top view of a portion of the frame illustrating the interlocking nature of the cross slats and the side rails.

A preferred embodiment of the structure according to the present invention is illustrated in the drawings. The structure is generally depicted at 10 and includes a pair of parallel side rails 12 and 14 which preferably are rectangular or oblong in cross section and which are mounted on edge. By rectangular or oblong in cross section it is intended to include all structures whose cross section has one dimension which is greater than that normal to it. A member placed or mounted on edge is one oriented with its greater cross sectional dimension extending generally vertically, while a member located on its side is one oriented with its greater cross section dimension extending generally horizontally. End members 16 and 18 are located between the side rails at either end thereof, and normally at least one center slat 48 extends between the end members 16 and 18, parallel to the side rails 12 and 14. A plurality of cross slats 20 are interlockingly engaged in the side rails 12 and 14 as will be described in greater detail herein.

The end members 16 and 18 are structurally identical, and therefore detailed discussion will be directed only to the end member 16. It first includes a base slat 22 extending between the side rails 12 and 14. As illustrated, the base slat 22 is attached to the side rail 12 in a recess 24 therein, and similarly, it is attached to the side rail 14 in a recess 26. Preferably, the depth of the recesses 24 and 26 will match the thickness of the base slat 22 so that their junction is flush, the bottom side of the structure 10 therefore being smooth without any protuberances or recesses as is customary with foundation unit frames. Attachment of the base slat 22 to the side rails 12 and 14 may be nailing, gluing, or any other means of securely affixing the base slat 22 to the side rails.

The end member 16 also includes an end slat 28 extending between the side rails 12 and 14 above the base slat 22. The end slat 28 has formed at each end thereof a tenon 30, preferably in a wedge-shaped, dovetail fashion. A corresponding mortise 32 is excised from the surface 34 of the side rail 12, and likewise, a corresponding mortise 36 is excised from the surface 38 of the side rail 14. When the frame unit is assembled with the end slat 28 extending between the side rails 12 and 14, each tenon 30 securely engages its respective mortise 32 or 36 in a mating tongue and groove fashion. The end slat 28 also lies upon and abuts the base slat 22 as illustrated.

As conventional in the majority of foundation unit structures, the corner 40 of the base slat 22 and the corner 42 of the side rail 12 are rounded. Similarly, the corner 44 of the base slat 22 and the corner 46 of the side rail 14 are also rounded.

Figure 2:
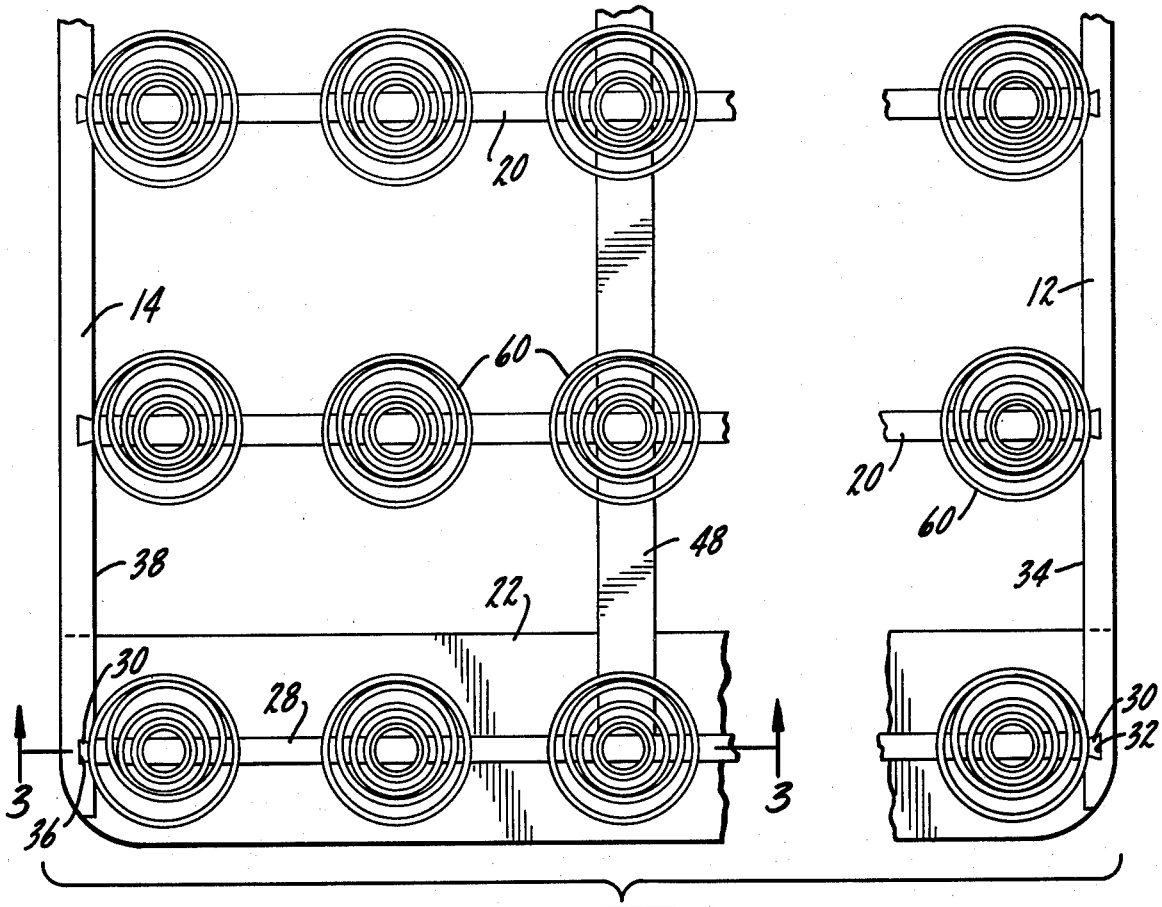
FIG. 2 is a partial top view of the apparatus according to the invention, with portions removed.

Normally, although not necessary in all box spring frame structures, the structure 10 will include one or more center slats 48. The center slat 48 extends from one end member 16 to the opposite member 18, substantially parallel to the side rails 12 and 14, abutting each of the end slats (as illustrated in FIG. 2). The center slat 48 can be attached in any conventional manner to the base slats and end slats, and serves as an additional support and strengthening member for the foundation unit structure 10.

Figure 3:
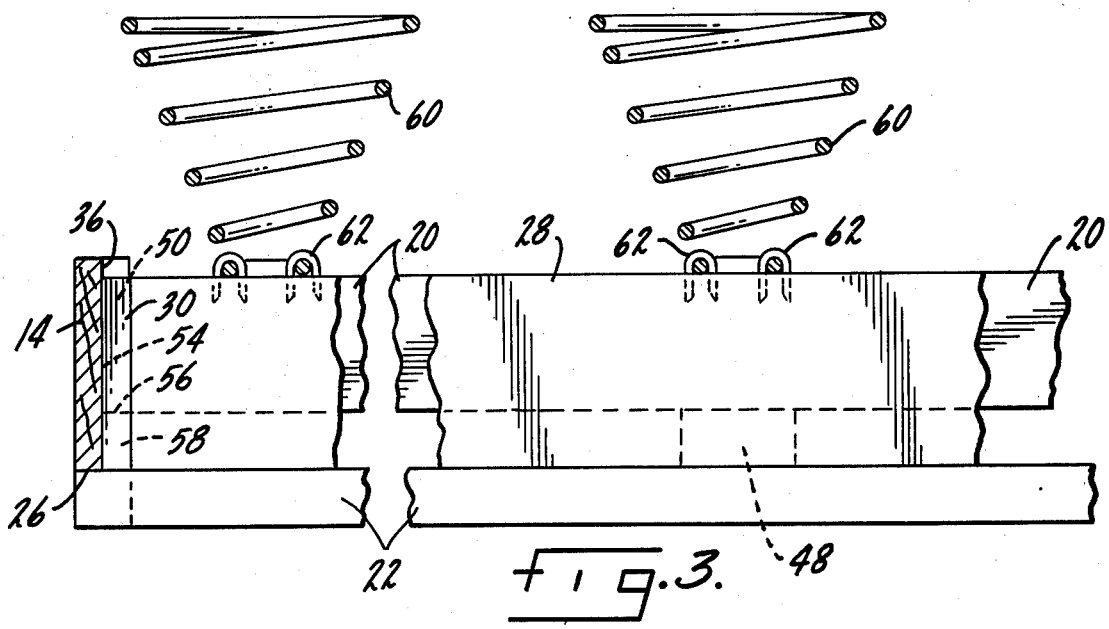
FIG. 3 is an enlarged cross sectional side view taken along line 3—3 of FIG. 2.

Each of the cross slats 20 extends between the side rails 12 and 14, generally perpendicular thereto. At the end of each cross slat 20 there is formed a tenon 50, which is preferably wedge-shaped or dovetailed, with the widest portion at the outer end. One such tenon engages a corresponding mortise 52 formed in the surface 34 of the side rail 12, and the other tenon engages a mortise 54 formed in the surface 38 of the side rail 14. Each of the mortises 52 and 54 is excised or hewn from its respective side rails 12 and 14 only to the extent necessary to accommodate one of the tenons 50. Therefore, in addition to firmly gripping each of the tenons 50, the side rails 12 and 14 firmly support each of the cross slats 20 above the base of the side rails 12 and 14. As best illustrated in FIG. 3, each mortise 54 is excised from the side rail 14 and terminates at a ledge 56, leaving a substantial portion 58 of the side rail 14 beneath the tenon of each cross slat 20 as a support therefore. The mortises 52 and 54 and tenons 50 are also normally formed so that the plane formed by the top edges of the side rails 12 and 14 is concurrent with the plane formed by the top edges of the cross slats 20 and the two end slats. However, as illustrated in FIG. 3, there may be some disparity due to standard slat and rail sizes utilized so that the plane of the top edges of the cross slats is only parallel to the top edges of the side rails. As long as there remains a substantial portion 58 of the side rail 12 beneath each cross slat 20 and each cross slat 20 is of a sufficient load-bearing depth, these planes need not necessarily coincide.

As in the conventional foundation unit, a plurality of spring members 60 is attached to each of the cross slats and end slats. Attachment may be effected in any conventional manner and as illustrated in FIG. 3, the spring members 60 are attached to the cross and end slats by a plurality of staple members 62.

Since all supporting slats and rails are situated on edge, the height of the spring members 60 is substantially less than that of a conventional foundation unit, resulting in a savings of spring material and a consequential reduction of cost of a foundation unit without sacrificing the resiliency of support required of the unit. The overall thickness of a foundation unit is normally on the order of 7 inches. If the side rails 12 and 14 are approximately 3½ inches in depth, the spring members need be only approximately 3 inches in depth, allowing for ½ inch of padding and cover material as is customary. The traditional unit has approximately 1 to 1½ inches of wooden framework and up to 6 inches of spring material. Since the springs are more costly than the framework structure, and since the strength of each spring member must be increased as the depth thereof is increased, a substantial material and cost savings is realized by the present invention over conventional foundation unit structures without sacrificing any of the desired support characteristics thereof. As can be appreciated, due to placement of all support slats and rails on edge, and in view of the interlocking nature thereof, the present invention produces a structure of greatly increased strength compared to the traditional unit.

When the tenons 30 of each end slat 28 are engaged within their respective mortises 32 and 36 in the side rails 12 and 14, and likewise when the tenons 50 of each cross slat 20 are engaged within their respective mortises 52 and 54, the slats and side rails are rigidly interconnected so that the assembled frame structure is extremely solid and stable. Unlike the conventional unit frame which has cross slats located on their sides and nailed to side rails also located on their sides, torsional forces are resisted by the present invention. In fact, the present foundation unit will be deformed only when there is a structural failure, ie. when a tenon is sheared from a slat or a mortise is fractured. Due to its lapped rather than interfitting cnstruction, the conventional box spring frame structure need not have a structural failure before there is deformation of its framework when forces are applied thereto.

Placement of the slats 20 and 28 on edge greatly increases the load bearing capacity of the present invention over a conventional foundation unit frame. In the conventional structure, each slat is on the order of ½ to 1 inch thick, so that each is easily susceptible to breakage when abnormal shearing forces are experienced by the structure such as a child jumping on a bed of which the unit frame forms the base. However, the present invention employs cross slats of approximately 2 inches in depth, greatly increasing the bearing capacity and substantially reducing the likelihood of a structural failure even if the foundation unit is abused.

Not only does placement of the slats on edge greatly increase the strength of the unit while at the same time reduce material costs, supporting the tenon 50 of each cross slat 20 on the ledges 56 of each side rail 12 and 14 also produces a strong and stable structure. For a vertical structural failure of a side rail to occur, as illustrated in FIG. 3, the portion 58 of the side rail 14 beneath each tenon 50 must be physically disjoined from the surrounding portions of the side rail. As is well known in the furniture industry, such a separation would require a substantial quantity of shearing force, far greater than the forces normally borne by the foundation unit structure.

When one or more center slats 48 is employed, the torsional rigidity of the unit is further enhanced. The center slat 48 works in operative combination with the dovetail interface between the slats and side rails to strengthen the structure and further resist any twisting forces which may be inadvertantly applied to the structure, such as those experienced when the assembled unit frame is accidentally dropped on one corner.

After the various frame structural components are cut to size and the desired tenons and mortises milled therein, the structure may be shipped in a disassembled state. It is easily assembled by first attaching each base slat within the recesses on either end of the side rails 12 and 14. An end slat is then engaged in the mortises located at either end of the side rails 12 and 14 above the base slats, and, if required, one or more of the center slats 48 is affixed in place. Lastly, each cross slat is inserted in its corresponding mortises in the side rails. Due to the construction of the mortises, and tenons, the cross slats can be forced-fitted within the side rails 12 and 14, or can be glued or nailed therein as required. The spring members 60 can then be attached to the cross and end slats, desired padding material placed on top of the spring members and a cover placed thereover and stapled to the side rails and the base slats.

It should be apparent that various modifications and changes may be made to the structure of the present invention without departing from the true spirit thereof or the scope of the following claims.

I claim:

1. A framework structure for a foundation unit including a. a pair of spaced, elongated parallel side rails oriented with their greatest cross sectional dimension extending generally vertically, b. a pair of end members extending between said side rails at opposite ends thereof, each of said end members comprising:

i. a base slat extending between said side rails, said base slat being oriented with its greatest cross sectional dimension extending substantially horizontally and being located in a recess excised from each end of each side rail which is shaped to accommodate the base slat, and ii. an end slat extending between said side rails above said base slat, said end slat being oriented with its greatest cross sectional dimension extending generally vertically and having formed at either end thereof a tenon which matingly engages a conforming mortise excised from each side rail, said tenon being formed in a wedge-shaped, dovetail configuration such that said tenon and said mortise interlock in a tongue and groove fashion, c. a plurality of cross slat members extending between said side rails intermediate the ends thereof, each of said cross slat members being oriented with its greatest cross sectional dimension extending generally vertically, said greatest cross sectional dimension of the cross slat members being less than the greatest cross sectional dimension of said side rails, and d. means interlocking each end of said cross slat members internally within said side rails to prevent relative movement therebetween.

2. The framework structure according to claim 1 in which said tenon is formed in a wedge-shaped, dovetail configuration so that said tenon and said mortise interlock in a tongue and groove fashion.

3. The framework structure according to claim 1 including at least one elongated center slat, oriented with its major cross sectional dimension extending generally horizontally, extending between said end members.

4. The framework structure according to claim 3 in which each end of said center slat rests upon, and is affixed to, each base slat, and said center slat extends between said end members beneath said cross slat members.

5. The framework structure according to claim 1 in which said means interlocking comprises a tenon formed at the end of each of said cross slat members extending the length of the greatest cross sectional dimension thereof, and a comforming mortise excised from said side rails.

6. The framework structure according to claim 5 in which each or said mortises is excised from said side rails, extending from the top thereof, only to the extent necessary to accommodate said tenons, creating an integral ledge portion for support of said cross slat members in said side rails beneath each of said mortises.

7. A framework structure for a foundation unit including a. a pair of spaced, elongated, parallel side rails oriented with their greatest cross sectional dimension extending generally vertically, b. a pair of end members extending between said side rails at opposite ends thereof, c. a plurality of elongated cross slat members extending between said side rails intermediate said end members, each of said cross at members being oriented with its greatest cross sectional dimension extending generally vertically, said greatest cross sectional dimension of the cross slat members being less than the greatest cross sectional dimension of the side rails, and d. means interlocking each end of said cross slat members internally within said side rails comprising a tenon formed at the end of each of said cross slat members extending the length of the greatest cross sectional dimension thereof, and a conforming mortise excised from said side rails, extending from the top thereof, only to the extent necessary to accommodate said tenons, creating an integral internal ledge portion in said side rails beneath each of said mortises for support of said cross slat members.

* * * * *